United States Patent [19]

Pabst

[11] Patent Number: 4,526,533

[45] Date of Patent: Jul. 2, 1985

[54] CYLINDER FOR GUIDING A WEB OF TEXTILE MATERIAL

[75] Inventor: Manfred Pabst, Cologne, Fed. Rep. of Germany

[73] Assignee: A. MONFORTS GmbH & Co., Monchen-Gladbach, Fed. Rep. of Germany

[21] Appl. No.: 426,691

[22] Filed: Sep. 29, 1982

[30] Foreign Application Priority Data

Oct. 2, 1981 [DE] Fed. Rep. of Germany ..... 3139254

[51] Int. Cl.[3] ..... F28D 11/02; F28F 5/02

[52] U.S. Cl. ..... 432/4; 165/89; 165/104.21; 165/134 R; 219/469; 432/91; 432/228; 432/227

[58] Field of Search ..... 165/104.21, 89, 104.26, 165/134 R, 1; 219/469, 470; 432/91, 228, 4, 227

[56] References Cited

U.S. PATENT DOCUMENTS

| | | | |
|---|---|---|---|
| 2,026,423 | 12/1935 | Fiene | 165/104.21 |
| 3,185,816 | 5/1965 | Lusebrink | 165/89 |
| 3,229,759 | 1/1966 | Grover | 165/104.26 |
| 3,619,539 | 11/1971 | Taylor | 219/469 |
| 3,952,798 | 4/1976 | Jacobson et al. | 165/104.26 |

FOREIGN PATENT DOCUMENTS

| | | | |
|---|---|---|---|
| 140243 | 10/1979 | Japan | 219/470 |

OTHER PUBLICATIONS

Fiske, J. M., *Heat-Exchange Drum,* Research Disclosure, No. 149, pp. 96-97, 9/1976, Industrial Opportunities Ltd., Homewell, Havant, Hants PO91EF, England.

*Primary Examiner*—Albert W. Davis, Jr.
*Attorney, Agent, or Firm*—Herbert L. Lerner; Laurence A. Greenberg

[57] ABSTRACT

The cylinder for guiding a web of textile material comprises at least one hollow space which is partly filled with a liquid heat carrier and can be evacuated. The pressure increase in the hollow space if the temperature is increased is to be limited to values below a multiple of calculated safety even though heat carriers with a steeply rising vapor pressure curve such as water are used. The solution consists in that only a quantity of heat carrier which can be evaporated completely in the volume of the hollow space already before a predetermined vapor pressure is reached, is contained in the hollow space.

9 Claims, 3 Drawing Figures

CYLINDER FOR GUIDING A WEB OF TEXTILE MATERIAL

Figure 1:
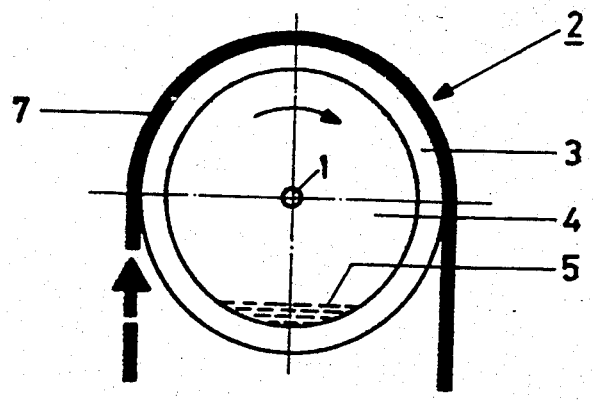

The invention relates to a cylinder for guiding a web of textile or similar flexible material which comprises at least one hollow space which is partly filled with a liquid heat carrier and can be evacuated. The cylinder is preferably designed or used, if the heat carrier is heated, for the thermal treatment of the web of material.

Apparatus with such a cylinder is described in German Published Prosecuted Application DE-AS No. 20 27 420. There, it is provided to evacuate the hollow space down to the saturated vapor pressure of the heat carrier liquid at the operating temperature and to thereby heat the heat carrier liquid in operation to the boiling temperature. The known system serves to achieve a highly constant temperature on the entire surface of cylinder shell with the lowest possible manufacturing and operating costs. For this purpose, the fact is utilized that in a closed system, a liquid which is in free exchange with its vapor phase is always at equilibrium with the latter and thus, the temperature of the overall system is only a function of the saturation vapor pressure of the liquid.

In the known system, a treatment temperature which is the same on the entire length of the shell surface of the cylinder provided for the thermal treatment of the web of material can be preselected and controlled in a simple manner by allowing the pressure of the system to rise to a desired value by supplying energy and thereby, a temperature which is accurately defined by the vapor pressure curve of the heat carrier is obtained.

Very different liquids can be used as heat carriers. Because of the pressure increase in the hollow space on the vapor pressure curve of the heat carrier liquid in the hollow space, it may be advantageous to use a heat carrier, such as a mixture of diphenyloxide and diphenyl, which has at the treatment temperatures of, for instance, 200° to 400° C. commonly used for textiles, a vapor pressure which can be controlled with vessels of relatively inexpensive design. Such heat carriers are expensive, however, and are as a rule chemically unstable when heated. Therefore, water is used in preference as the heat carrier in practice in spite of its high vapor pressure and the heavy design of the cylinder as a pressure vessel due to the vapor pressure. However, a disadvantage must be tolerated in this case, which is that each individual cylinder is subject, as a pressure vessel, to an official technical test.

It is an object of the invention to develop the cylinder mentioned at the outset further in such a way that the advantages obtainable therewith can also be achieved with a smaller pressure increase in the hollow space enclosed by the cylinder. The solution according to the invention consists in that only a quantity of heat carrier which can already be evaporated completely in the volume of the hollow space already before a predetermined maximally permissible vapor pressure is reached, is contained in the hollow space.

This means in other words that the quantity of heat carrier liquid contained in the hollow space is matched to the volume of the hollow space in such a way that the heat carrier liquid can be completely evaporated in the hollow space before a predetermined maximally permissible vapor pressure is reached. According to further invention, the quantity of heat carrier liquid contained in the hollow space is matched to the volume of the hollow space so that the vapor pressure which the liquid reaches, until it evaporates completely into the hollow space, is at most a small fraction of the calculated safety (see the regulations of the German Technical Surveillance Association—Deutscher Technischer Ueberwachungsverain) and upon a further temperature increase, still increases only approximately according to the gas state change for constant volume (isochoric).

With the invention it is achieved that the vapor pressure in the cylinder increases only up to a predetermined pressure value, or to a predetermined pressure value, at which the entire liquid contained in the hollow space is evaporated; rises along the relatively steeply rising vapor pressure curve and from there on follows only the state change for constant volume. In particular the pressure increase along the vapor pressure curve is to be limited to the value corresponding to about three-times the calculated safety.

It is to be noted that constant temperature must be guaranteed on the cylinder surface theoretically only up the temperature which corresponds to the vapor pressure when the heat carrier liquid is completely evaporated. To particular advantage, the temperature corresponding to complete evaporation of the heat carrier is therefore set at such a point by predermining the quantity of heat carrier that until the temperature is reached, heat treatments in which a highly constant temperature is essential, for instance, for drying a wet web of material, can essentially be carried out or completed, and that higher temperatures are used only in treatment processes in which the web of material is also, or primarily heated from the outside, i.e., from outside the respective cylinder. The cylinder then serves essentially only for guiding the web of material, and the temperature at the web of material width need not be kept so extremely constant as in drying. This, for instance, applied to the fixing of definite states of already dry webs of textile material, especially in a hot flue which has optionally a multiplicity of guide cylinders according to the invention.

Figure 2:
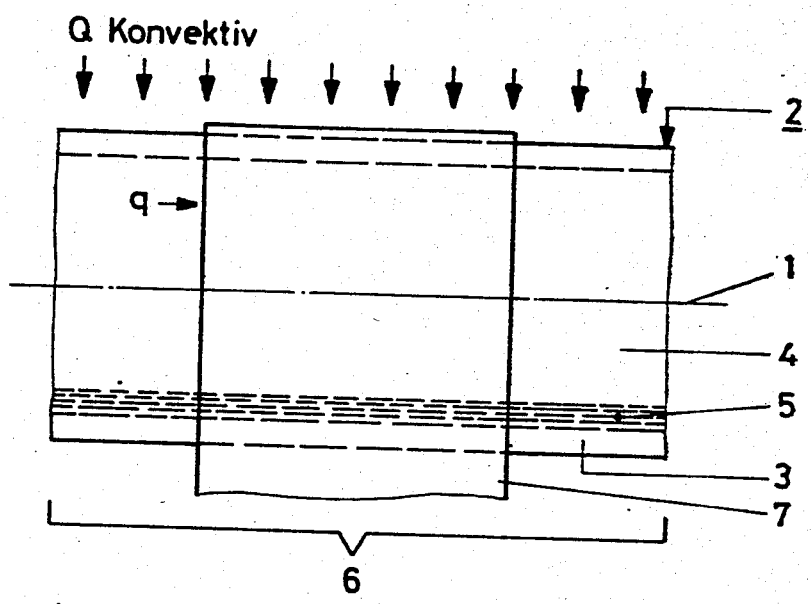
Figure 3:
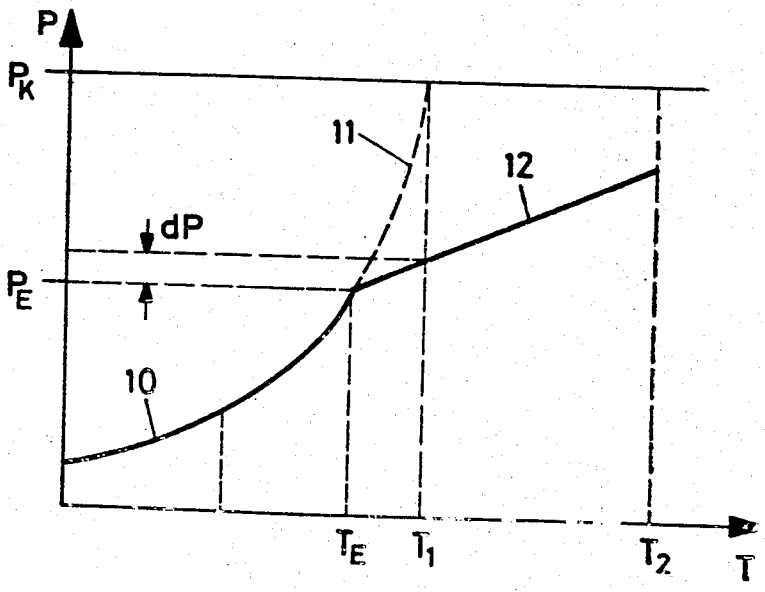

Referring to the schematic presentation in the drawing, further details of the invention will now be explained, where FIGS. 1 and 2 show a cylinder in a cross and a longitudinal section; and FIG. 3 shows a pressure-temperature diagram of the heat carrier in the cylinder according to FIG. 1 and 2.

FIG. 1 shows a cross section perpendicular to the axis of rotation 1 of a cylinder designated as a whole with 2. In the embodiment example, the cylinder shell 3 encloses a hollow space 4. In the hollow space 4 which can be evacuated and sealed after the evacuation, there is a quantity of a heat carrier liquid 5. The latter is apportioned so that it can be evaporated completely within the hollow space 4 even before a predetermined maximally permissible vapor pressure is reached. A web of material 7 is guided on the cylinder 2.

FIG. 2 shows a section parallel to the axis of rotation 1 corresponding to FIG. 1. On the entire length 6 of the treatment cylinder 2, the temperature can be held constant with external and/or internal energy supply Q even if the web of material to be treated occupies only part of the length 6 of the cylinder 2. Therefore, when, among other things, a web of material 7 is dried, overdrying of the edges of the web of material, for instance, by heat conduction q in the cylinder jacket 3 is to be prevented. This goal can be achieved as long the liquid 5 in the hollow space 4 is at equilibrium with the vapor phase of the latter. In the cylinder according to the invention, the condition is met until that vapor pressure is reached at which the entire liquid 5 is evaporated into the hollow space 4. Upon a further increase of the temperature, the desired constant temperature no longer holds exactly over the length 6 of the cylinder 2, but for these temperatures it is assumed that the drying process is completed and the web of material 7 as well as the cylinder 2 assume the temperature of an external treatment medium.

A diagram of the pressure curve P within the hollow space 4 of the cylinder 2 is schematically shown in FIG. 3 as a function of the temperature T. If the temperature T is increased in the direction of the arrow, the pressure P inside the hollow space 4 of the cylinder 2 rises along the vapor pressure curve 10. A relatively steep rise of the pressure P is obtained here, especially with water as the heat carrier. This rise would continue along the line 11 without the measure according to the invention, for instance to a pressure $P_K$ at a temperature $T_1$ at which, for instance, a fixation treatment of a web of textile material is to be performed. If, however, in accordance with the invention, the quantity of heat carrier liquid 5 within the hollow space 4 is matched to the volume of the hollow space 4 in such a way that the liquid 5 can already be evaporated completely at the temperature $T_E$ i.e., before the pressure $P_K$ is reached, in the hollow space 4, the steep rise of the vapor pressure on the curve 10 already terminated for instance at the pressure $P_E$ and the temperature $T_E$ corresponding to this pressure. Since with a further temperature increase, for instance, up to the desired treatment temperature $T_1$, the pressure still rises only isochorically substantially along the straight line 12, only a relatively small pressure increase results if the temperature is increased to the value $T_1$.

In operation according to the invention, one can also operate at substantially higher temperatures than heretofore, for instance, at the temperature $T_2$, because even at these high temperatures, the pressure which is rising according to the gas state equation for constant volume, will reach only values below the provided maximally permissible vapor pressure $P_K$.

I claim:

1. Cylinder assembly for guiding a web of textile or similar flexible material (7) which comprises a cylinder (2) having a shell (3) and at least one hollow space (4) formed therein, a heat carrier liquid (5) which can be evacuated being disposed in said hollow space, and means disposed outside said cylinder for heating said heat carrier liquid and in turn heating said shell to a temperature independent of the quantity of said carrier liquid disposed in said hollow space, said hollow space containing only a quantity of heat carrier liquid (5) which can be evaporated completely in the volume of the hollow space (4) before a predetermined maximally permissible vapor pressure is reached, and said hollow space having no heat source disposed therein.

2. Cylinder assembly according to claim 1, wherein the quantity of heat carrier liquid (5) contained in the hollow space (4) is matched to the volume of the hollow space so that the liquid can be evaporated in the hollow space completely before a predetermined maximally permissible vapor pressure is reached.

3. Cylinder assembly according to claim 1, wherein the quantity of heat carrier liquid (5) contained in the hollow space (4) is matched to the volume of the hollow space so that the vapor pressure of the liquid (5) reaches at most the value corresponding to 3-times the calculated safety pressure until it is completely evaporated into the hollow space (4) and, upon further increase of the temperature, still rises only approximately corresponding to the gas state equation for constant volume.

4. Cylinder assembly according to claim 2, wherein the quantity of heat carrier liquid (5) contained in the hollow space (4) is matched to the volume of the hollow space so that the vapor pressure of the liquid (5) reaches at most the value corresponding to 3-times the calculated safety pressure until it is completely evaporated into the hollow space (4) and, upon further increase of the temperature, still rises only approximately corresponding to the gas state equation for constant volume.

5. Cylinder assembly according to claim 1, wherein said heating means are in the form of a hot flue.

6. Method of treating a web of textile or similar flexible material guided over a cylinder having a shell, at least one hollow space formed in the shell, and means disposed outside the cylinder for heating the hollow space, which comprises selecting a predetermined maximally permissible vapor pressure in the hollow space, filling a quantity of heat carrier liquid into the hollow space which can be completely evaporated in the volume of the hollow space before the predetermined maximally permissible vapor pressure is reached, and heating the heat carrier liquid with the heating means until the heat carrier liquid evaporates, whereby the shell is in turn heated to a temperature independent of the quantity of the heat carrier liquid filled into the hollow space.

7. Method of treating a web of textile or similar flexible material guided over a cylinder having a shell, at least one hollow space formed in the shell, and means disposed outside the cylinder for heating the hollow space, the hollow space having no heat source disposed therein, which comprises selecting a predetermined maximally permissible vapor pressure in the hollow space, filling a quantity of heat carrier liquid into the hollow space which can be completely evaporated in the volume of the hollow space before the predetermined maximally permissible vapor pressure is reached, and heating the heat carrier liquid with the heating means until the heat carrier liquid evaporates, whereby the shell is in turn heated to a temperature independent of the quantity of the heat carrier liquid filled into the hollow space.

8. Method according to claim 6, which comprises calculating a maximum safety pressure of the cylinder, heating the cylinder with the heating means until the vapor pressure of the heat carrier liquid is at most three-times the calculated safety pressure and the heat carrier liquid is evaporated, and further heating the cylinder with the heating means until the vapor pressure of the heat carrier liquid rises and substantially corresponds to the gas state equation for constant volume.

9. Method according to claim 7, which comprises calculating a maximum safety pressure of the cylinder, heating the cylinder with the heating means until the vapor pressure of the heat carrier liquid is at most three-times the calculated safety pressure and the heat carrier liquid is evaporated, and further heating the cylinder with the heating means until the vapor pressure of the heat carrier liquid rises and substantially corresponds to the gas state equation for constant volume.

* * * * *